United States Patent [19]

Wemyss

[11] 4,150,516

[45] Apr. 24, 1979

[54] FRAMEWORK AND SHEET MATERIAL BUILDING STRUCTURE

[76] Inventor: George A. Wemyss, 2 Mitchell's Close, Haddington, E. Lothian, Scotland

[21] Appl. No.: 850,252

[22] Filed: Nov. 10, 1977

[30] Foreign Application Priority Data

Nov. 12, 1976 [GB] United Kingdom ..... 47326/76
Mar. 7, 1977 [GB] United Kingdom ..... 9545/77

[51] Int. Cl.[2] ..... E04B 1/32
[52] U.S. Cl. ..... 52/86; 52/222; 52/644; 52/643
[58] Field of Search ..... 52/63, 222, 86, 644, 52/643; 135/DIG. 1, DIG. 8

[56] References Cited

U.S. PATENT DOCUMENTS

| | | | |
|---|---|---|---|
| 2,436,543 | 2/1948 | Blaski | 52/86 X |
| 3,690,078 | 9/1972 | Maynard, Jr. | 52/86 |
| 3,811,454 | 5/1974 | Huddle | 52/63 X |
| 3,854,254 | 12/1974 | Janosko | 52/63 |
| 4,070,846 | 1/1978 | Sohlberg | 52/86 X |

*Primary Examiner*—Ernest R. Purser
*Assistant Examiner*—Carl D. Friedman
*Attorney, Agent, or Firm*—Neil F. Markva

[57] ABSTRACT

A building structure is made up from a framework covered by sheet material. The building structure has a generally rectangular floor plan. The framework has two end structures and a main body portion composed of a plurality of interconnected parallel arches which extend at right-angles to an axis of symmetry of the floor plan of the building structure. The sheet material is connected to the framework under tension so as to increase the strength of the finished building structure.

24 Claims, 12 Drawing Figures

FRAMEWORK AND SHEET MATERIAL BUILDING STRUCTURE

BACKGROUND OF THE INVENTION

This invention relates to a building structure made from a framework covered with sheet material.

SUMMARY OF THE INVENTION

The present invention provides a building structure made up from a framework covered by sheet material, the building structure having a generally rectangular floor plan, the framework being composed of a plurality of interconnected parallel arches which extend at right-angles to an axis of symmetry of the floor plan of the building structure, the two ends of the "tunnel" formed by these interconnected arches each being closed by an end structure, wherein the sheet material is connected to the framework under tension.

Advantageously, each arch is constituted by a plurality of identical struts joined end-to-end. Preferably the framework of each end structure is constituted by a plurality of arch members, and each arch comprises a pair of symmetrically disposed arch members. In this case, each arch member is constituted by at least two of said identical struts joined end-to-end.

Preferably, each arch member is constituted by three of said identical struts, the angle between each pair of adjacent struts being 157½°.

Obviously, the length of this building structure can be varied by increasing the number of arches. However, it is also possible to increase the width of the structure by including further struts in each arch. In the simplest case, one additional strut (identical to all the others) is included as a ceiling strut between the ends of the two arch members of that arch. This additional strut thus meets each of the two adjacent struts at an angle of 157½°. In this case, the arch members which form the ends of the structure may each be joined to the nearest arch by a further strut which is half the length of the main struts.

Preferably, a short vertical strut is provided at each end of each arch, and at the lower end of each arch member. Advantageously, each short vertical strut has a length half that of said identical struts.

The arches of the building structure are preferably joined together by means of cross-pieces. Advantageously, each of these cross-pieces is of substantially identical form to the struts. Consequently, it is possible to build the entire framework of the building structure from one single type of component, though other components (such as the half-strut required for the ends of some forms of structure) may also be used.

Alternatively, the framework of each end structure may be constituted by two interconnected corner assemblies, each corner assembly being constituted by three frame members each in the form a quadlilateral having two shorter sides of equal lengths and two longer sides of equal lengths, the angles between pairs of adjacent sides being substantially 81.6°, 81.6°, 81.6° and 115.2° respectively.

In this case, each of the longer sides of each frame member is constituted by one of said identical struts. and the two corner assemblies of each end structure are connected by cross-pieces which are substantially identical to said identical struts, and wherein each arch is constituted by five of said identical struts.

Advantageously, each strut is constituted by a hollow tube, preferably made of aluminium. The struts may be joined together using any suitable type of connector such as a connector having arms which telescope into the open ends of the struts. The connectors may rely on friction fitting for holding the struts together, though it is preferable if the connectors are welded, rivetted or bolted to the struts.

Preferably, each strut is a compound-braced strut, that is to say a strut constituted by a pair of parallel booms braced together by a series of cross-pieces laying at, for example, 45° to each of the booms. In this case, the booms may be hollow aluminium tubes of oval cross-section.

The building structure is covered by sheet material such as polyvinyl chloride coated woven fabric. Preferably, one strip of such material is provided between each pair of adjacent arches or half-arches. In this case, each edge of each strip is provided with beading which slides along, but cannot be moved laterally out of, correspondingly shaped slots in the edges of the two arch members concerned.

Advantageously, in the region of the ceiling of the structure, the sheet material is bowed slightly above the plane of the adjacent framework by means of rails which criss-cross between adjacent arches.

The invention also provides a building structure made up from a framework covered by sheet material, the framework having a generally rectangular floor plan and being constituted by a plurality of interconnected parallel arches which extend at right-angles to an axis of symmetry of the floor plan of the building structure, each arch being constituted by a plurality of identical struts joined end-to-end, wherein the sheet material is connected to the framework under tension.

In another aspect, the invention provides an arch member constituted by a pair of spaced-apart, interconnected parallel arches, each of which is constituted by a plurality of identical struts joined end-to-end, wherein the arches are covered by tensioned sheet material.

BRIEF DESCRIPTION OF THE DRAWINGS

Three forms of building structure constructed in accordance with the invention will now be described, by way of example, with reference to the accompanying drawings, in which.

DESCRIPTION OF THE DRAWINGS

Figure 1:
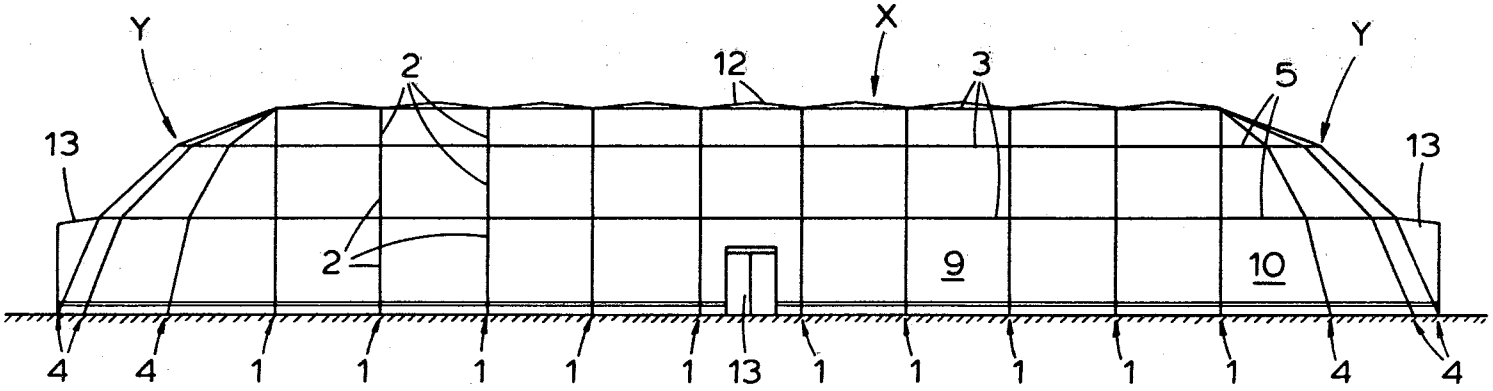
FIG. 1 is a side elevation of the first form of building structure.
Figure 2:
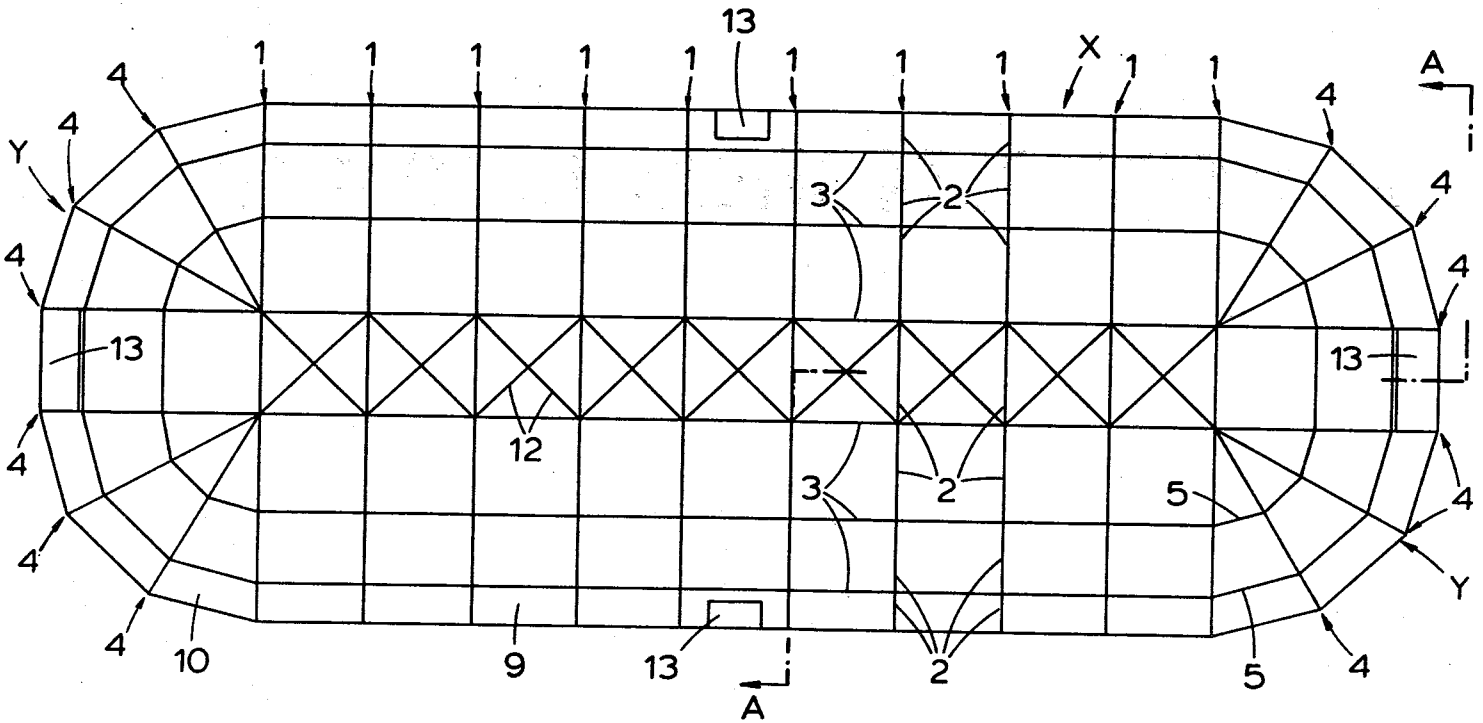
FIG. 2 is a plan view of the structure of FIG. 1.
Figure 3:
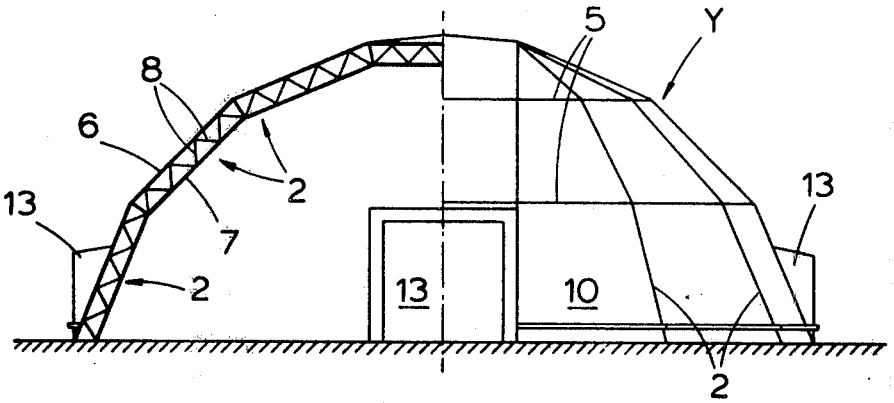
FIG. 3 is a cross-section taken on the line A—A of FIG. 2.

Referring to the drawings, FIGS. 1 to 3 show the first form of building structure which is constituted by a framework covered by sheet material. The framework has a main body section X and two end sections Y. The main body section has ten arches 1, each of which is constituted by seven identical struts 2 joined end-to-end by means of connectors (not shown). Each pair of adjacent struts 2 defines an inclined angle of 157½°, and the two ground-engaging struts lie at an angle of 67½° to the vertical. Each strut 2 has a mean length of 3.6 m. Adjacent arches 1 are connected together by cross-pieces 3 which are substantially identical to the struts. The cross-pieces 3 are connected to the struts by means of connectors (not shown).

Each end section Y is constituted by six arch members 4, each of which is made up of three of the struts 2 joined end-to-end by means of connectors (not shown). Each pair of adjacent struts 2 of each arch member 4 define an included angle of 157½°. Adjacent arch members 4 are joined together by means of cross-pieces 5 of appropriate lengths.

Figure 7:
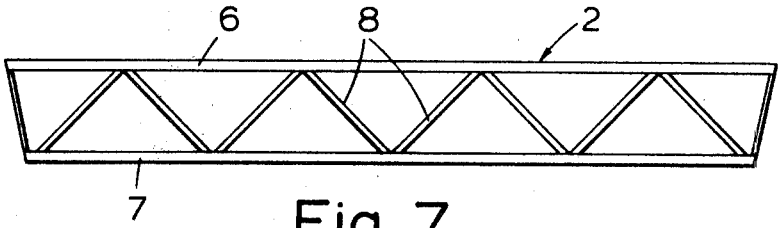
FIG. 7 is a detail view, on an enlarged scale, of one of the struts from which all three forms of building structure are constructed.
Figure 9:
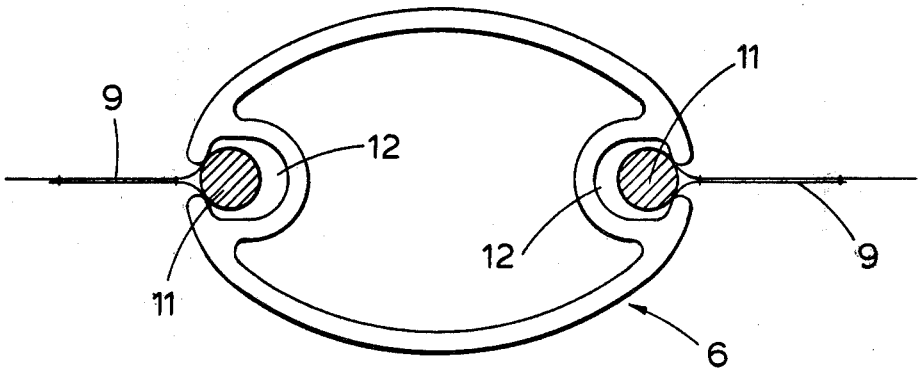
FIG. 9 is a detail view, on an enlarged scale showing how the sheet material is joined to the struts in all three forms of building structure.

Each of the struts 2 and the cross-pieces 3 and 5 is a compound-braced strut, that is to say it has (see FIG. 7) a front boom 6 and a rear boom 7 braced together by means of braces 8 which cross-cross between the two booms at angles of 45°. The only difference between the illustrated strut 2 and a cross-piece 3 is that the booms 6 and 7 of the latter are of the same length. Both booms 6 and 7 are made of hollow aluminium tubing of elliptical cross-section (see FIG. 9) having a major axis length 95 mm and a minor axis of length 55 mm. The braces 8 are aluminium tubes of diameter 38 mm and a wall thickness of 2 mm.

Each pair of adjacent arches 1 is provided with a strip 9 of polyvinyl chloride coated woven fabric. Similarly, strips 10 of this material are provided at the ends Y of the structure between adjacent arch members 4. Each strip 9 or 10 is provided, at each lateral edge thereof, with beading 11 which can be slid into grooves 12 formed in the edges of the front booms 6 of the arches 1 and arch members 4. Thus, the strips 9 and 10 can be slid into position so as to cover the entire area between its two arches 1 or arch members 4. In order to stretch the material of the strips 9 and 10 for the purpose of increasing the strength of the finished building structure, each strip has a width which is slightly less than the width between the corresponding arches 1 or arch members 4. Also, the ends of each strip 9 and 10 are connected to the corresponding arches 1 or arch members 4 so as to be under tension, longitudinally. Moreover, rails 12 are provided between the struts 2 forming the ceiling, the rails criss-crossing between adjacent struts and being bowed slightly out of the plane of the surrounding region of the main framework (see FIG. 1). The rails 12 are aluminium tubes having an outer diameter of 26 mm and a thickness of 2 mm. Not only does this stretching of the covering material increase the strength of the finished structure, but the bowing out at the ceiling also prevents rain water forming and gathering in depressions in the material.

As can be seen in FIG. 1, doors 13 are provided at various locations around the structure, these doors requiring special struts and connectors (not shown) for connection to the adjacent arches 1 or arch members 4.

Figure 4:
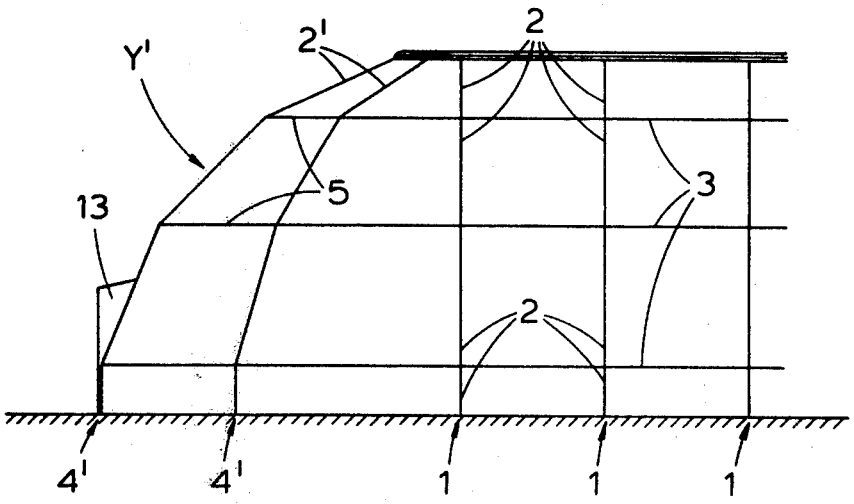
FIG. 4 is a side elevation of part of the second form of building structure.
Figure 5:
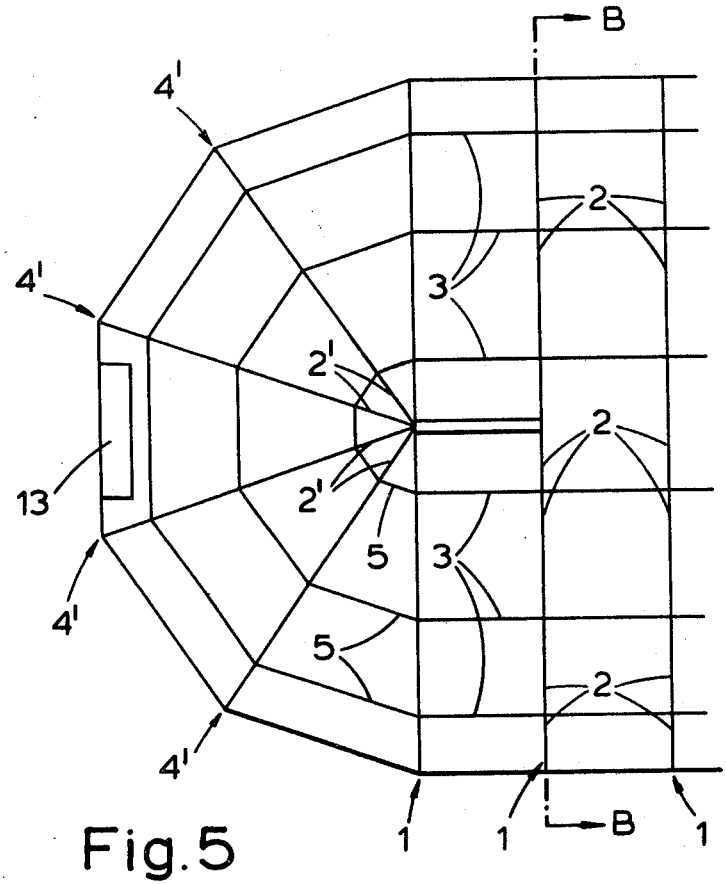
FIG. 5 is a plan view of that part of the second form of building structure shown in FIG. 4.
Figure 6:
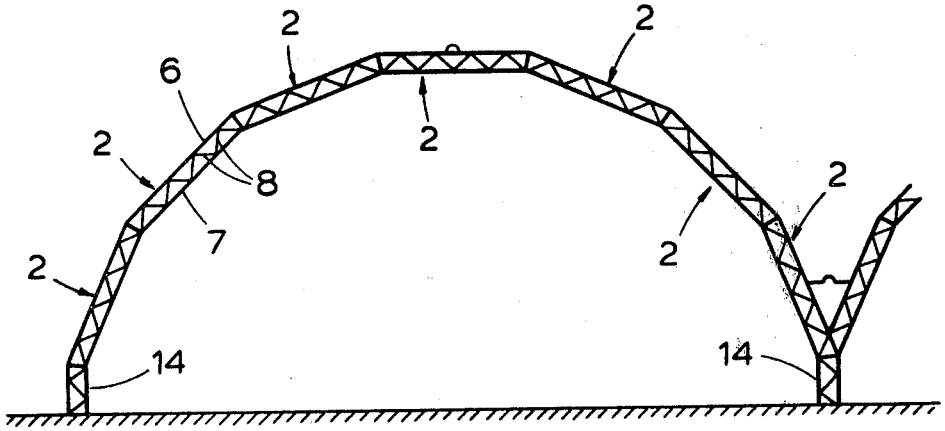
FIG. 6 is a cross-section taken on the line B—B of FIG. 5.
Figure 8:
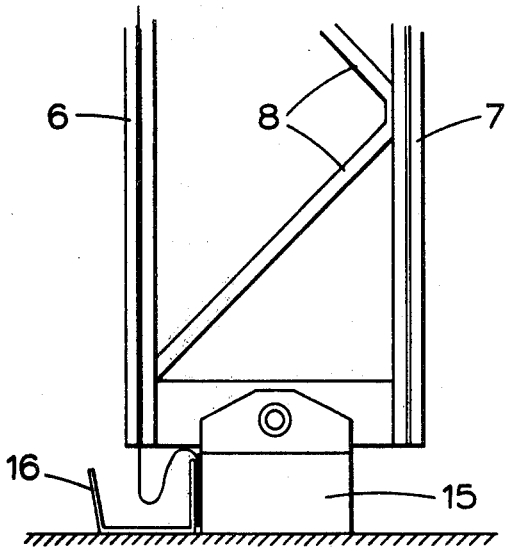
FIG. 8 is a detail view, on an enlarged scale, of the base of one of the struts of the second form of building structure.

The building structure shown in FIGS. 4 to 6 is identical with that shown in FIGS. 1 to 3 apart from the following differences. Firstly, each of the arches 1 and arch members 4 is supported on the ground by means of short vertical struts 14. These struts are similar to the struts 2 but have a length of only 1.3 m. As can be seen in FIG. 8, each of the struts 14 is anchored to the ground by means of an anchor plate 15 which is provided with guttering 16 for leading away rain water.

Secondly, each of the end sections Y′ is made up of four arch members 4′, each of which is constituted by three struts 2 and a further strut 2′. This further strut 2′ is similar to the struts 2 except that it has half their length. The advantage of this form of end structure Y′ is that it gives a slightly larger floor plan area than that of the end structure Y.

The third difference is that two similar units are joined side-by-side (see FIG. 6) each of which is a building structure of the type shown in FIGS. 4 and 5. Obviously, further units could be added on to increase further the size of the building. Similarly, further units of the type shown in FIGS. 1 to 3 could be added to the original unit so as to increase the size of that type of building structure.

This type of building structure is also covered with strips (not shown) of polyvinyl chloride coated woven fabric in a similar manner to that of the structure of FIGS. 1 to 3. Here again, stretcher rails (not shown) are provided for tensioning the ceiling covering material.

Figure 10:
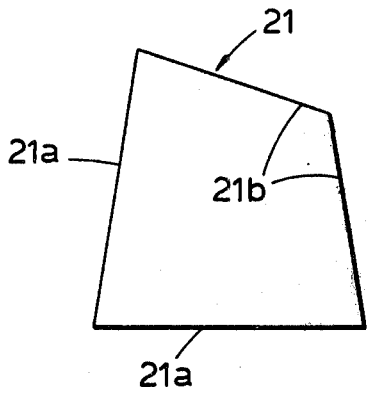
FIG. 10 shows schematically a frame member used in assembly the corner of a third form of building structure.
Figure 11:
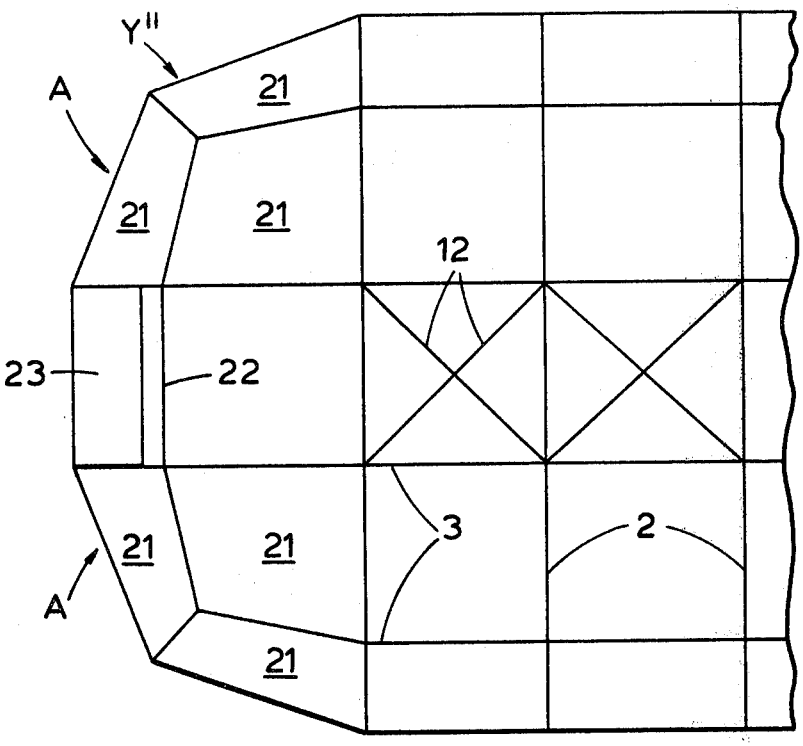
FIG. 11 is a plan view of one end of the third form of building structure.
Figure 12:
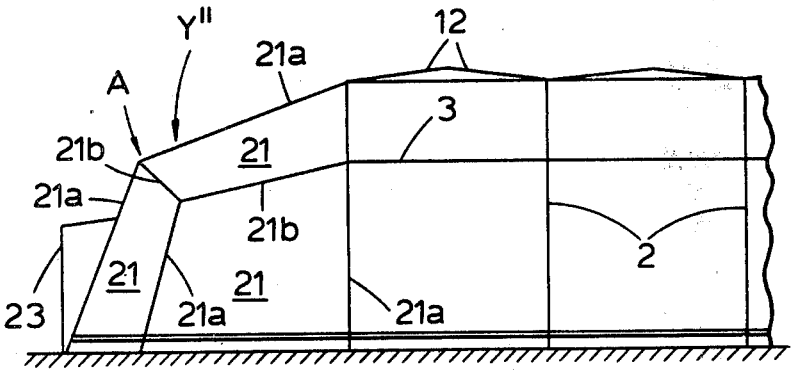
FIG. 12 is a side elevation of the structure of FIG. 11.

The building structure of FIGS. 10 to 12 is similar to that of FIGS. 1 to 3 apart from its end sections Y″ being of different formation and its main body section X″ having only five struts 2 instead of having seven struts as in FIGS. 1 to 3. This reduces the span of the structure to 45 ft. from the 60 ft. span of the structure of FIGS. 1 to 3. Like reference numerals are used in FIGS. 10 to 12 for the like parts of FIGS. 1 to 3. As the end sections Y″ are identical, one only will now be described.

Each end section Y″ is constituted by a pair of corner assemblies A, each of which is made up from three frame members 21 of quadlilateral form, the corner assemblies being joined together by cross-pieces 22 which are similar to the cross-pieces 3 of the embodiment of FIGS. 1 to 3, also having a length of 3.6 m. FIG. 10 shows a frame member 21 in the form of an open framework quadlilateral made from struts of the same type as the struts 2. The quadlilateral has two sides constituted by struts 21*a* each with a length of 3.6 m and two sides constituted by struts 21*b* each with a length of 2.785 m. Thus, the two longer sides each have a length of 0.765 r and the two shorter sides each have a length of 0.592 r, where r is the radius of the sphere on which lie the four vertices of the member 21 when it is combined with two identical members to form a corner assembly in the manner described below.

The three members 21 of each corner assembly A are put together so that each of the shorter struts 21*b* of any one of them forms one of the shorter struts 21*b* of each of the other two members.

The doors 23 is formed between the two corner assemblies A of each end section Y″. When the framework of the end sections Y″ have been erected, sheets of polyvinyl chloride coated woven fabric are fastened thereto in such a manner that the sheet material is slightly stretched.

It will be apparent, therefore, that the building structures described above are extremely versatile. They can be increased (or decreased) in size by the addition (or removal) or arches 1. They can also be increased in size by the addition of further struts 2 in the ceiling areas, though, where buildings of greater width are required, it is preferable (from the point of view of the strength of the finished structure) to do this by the addition of further units in a side-by-side relationship. Moreover, with the embodiments of FIGS. 1 to 9, this versatility is achieved using basically only one type of strut 2 (the cross-pieces 3 being substantially identical to the struts 2). Consequently, not only is the manufacturing process for the parts of such a structure relatively simple, but also erection of at least the main body X of the framework of the structure is relatively simple, as only one type of strut is needed. Also, the major part of the construction of the end sections Y, Y' needs only this same type of strut.

The embodiment of FIGS. 10 to 12 does use struts **21*b* which have different lengths from the struts 2**. Although this is disadvantageous from the point of view of economy of manufacturing the basic parts, it does not have the advantage of providing more headroom at the ends of the building structure and this is particularly useful for structures of smaller size.

In the embodiments described above, the cross-pieces 3 are only substantially identical to the struts 2, the slight difference being to account for the angling between the adjacent struts 2 of the arches 1. Alternatively, the cross-pieces 3 could be identical to the struts 2, in which case the joints between the struts 2 and the cross-pieces 3 need to be specially constructed. Although it is disadvantageous from the point of view that an extra basic component is required, it is advantageous in large building structures for the cross-pieces 3 to be different from the struts 2. This is because the struts 2 are the main load bearers of the framework and so need to be much stronger than the cross-pieces 3. Thus, in large building structures, it is economically preferable to make the cross-pieces of thinner material.

It is, of course, possible to modify the structures described above by, for example, leaving out the end sections Y, Y' and Y''. Such an open-ended structure may find uses on farms as shelters, for example, for haystacks, farm machinery, etc. However, as the end sections Y, Y' and Y'' add considerably to the strength and rigidity of the building structures, the use of open-ended structures should be restricted to the sort of building structure that does not require great strength.

I claim:

1. In a building structure made up from a framework covered by a sheet material, the building structure having a generally rectangular floor plan, the framework being composed of a plurality of interconnected parallel arches which extend at right-angles to an axis of symmetry of the floor plan of the building structure, the arches being joined together by means of cross-pieces to form a tunnel having two ends closed by an end structure, and the sheet material being connected to the framework under tension, the combination comprising:

(a) each said arch having at least four identical, rectilinear struts joined end-to-end, (b) each said cross-piece is of substantially identical form to said identical struts, and (c) a respective strip of said sheet material is connected between each pair of adjacent arches, (d) the width of each said strip being slightly less than the corresponding spacing between the arches, whereby the strips are tensioned transversely.

2. In a building structure according to claim 1, wherein the framework of each end structure is constituted by a plurality of arch members.

3. In a building structure according to claim 2, wherein a respective strip of sheet material is disposed between each pair of adjacent arch members, the transverse dimensions of each such strip being slightly less than the corresponding spacing in which it is positioned between the arch members whereby the strips are tensioned transversely, and said strips are fastened to the structure effective to be under tension longitudinally.

4. In a building structure according to claim 1, wherein each arch comprises a pair of symmetrically disposed arch members.

5. In a building structure according to claim 4, wherein each said arch member is constituted by at least two of said identical struts joined end-to-end.

6. In a building structure according to claim 5, wherein each arch member is constituted by three of said identical struts, the angle between each pair of adjacent struts being 157½°.

7. In a building structure according to claim 5, wherein each said arch member is constituted by three of said identical struts and a further strut, the further strut being half the length of said idential struts, and the angle between each pair of adjacent struts being 157½°.

8. In a building structure according to claim 1, wherein a short vertical sturt is provided at each end of each arch.

9. In a building structure according to claim 8, wherein each short vertical strut has a length half that of said identical struts.

10. In a building structure according to claim 1, wherein a short vertical strut is disposed at the lower end of each arch member.

11. In a building structure according to claim 10, wherein each short vertical strut has a length half that of said identical struts.

12. In a building structure according to claim 1, wherein each end structure includes two interconnected corner assemblies, each corner assembly includes three frame members each in the form of a quadlilateral having two shorter sides of equal lengths and two longer sides of equal lengths, the angles between pairs of adjacent sides of the frame members being substantially 81.6°, 81.6°, 81.6° and 115.2° respectively.

13. In a building structure according to claim 12, wherein each of the longer sides of each frame member is constituted by one of said identical struts.

14. In a building structure according to claim 13, wherein the two corner assemblies of each end structure are connected by cross-pieces which are substantially identical to said identical struts, and each arch is constituted by five of said identical struts.

15. In a building structure according to claim 1, wherein each of said identical struts is composed of a hollow tube.

16. In a building structure according to claim 1, wherein each strut is a compound-braced strut having a pair of parallel booms braced together by a series of cross-pieces lying at angles of substantially 45° to the boom.

17. In a building structure according to claim 16, wherein the booms are hollow aluminum tubes of oval cross-section.

18. In a building structure according to claim 1, wherein the sheet material is polyvinyl chloride coated woven fabric.

19. In a building structure according to claim 1, wherein each strut includes shaped slots extending along opposed lateral edges of said struts, and each edge of each strip has beading which slides along, but cannot be moved laterally out of, said shaped slots in the struts of the arches concerned.

20. In a building structure according to claim 3, wherein each strut includes shaped slots extending along opposed lateral edges of said struts, and each edge of each strip has beading which slides along, but cannot be moved laterally out of, said shaped slots in the struts of the arch members concerned.

21. In a building structure according to claim 1, wherein rails criss-cross between adjacent arches in the region of the ceiling of the structure and extend slightly above the plane of the building framework, and the sheet material in said ceiling region is disposed over said rails to also bow slightly above the plane of said building framework.

22. A building structure having a generally rectangular floor plan and composed of a framework covered by a sheet material, said framework comprising:

(a) a plurality of interconnected parallel arches which extend at right-angles to an axis of symmetry of the floor plan of the building structure, (b) said interconnected arches forming a tunnel having two ends which are closed by an end structure constituted by a plurality of arch members, (c) each of the arches and each of the arch members being constituted by a plurality of identical rectilinear struts joined end-to-end, (d) the arches being joined together by means of cross-pieces which are of substantially identical form to said identical struts, (e) a respective strip of sheet material is secured between each pair of adjacent arches, (f) the width of each said strip being slightly less than the corresponding spacing in which it is secured between the arches whereby the strips are tensioned transversely, (g) said strips being further fastened to the structure to be under tension longitudinally, (h) a further respective strip of sheet material is secured between each pair of adjacent arch members, (i) the transverse dimensions of each said further strip are slightly less than the corresponding spacing in which it is secured between said adjacent arch members, whereby these further strips are tensioned transversely, and (j) said further strips being fastened to the structure to be under tension longitudinally.

23. A building structure having a generally rectangular floor plan and composed of a framework covered by a sheet material, said framework comprising:

(a) a plurality of interconnected parallel arches which extend at right-angles to an axis of symmetry of the floor plan of the building structure, (b) each said arch including at least four identical, rectilinear struts, (c) cross-pieces having substantially identical form to said identical struts connecting said arches together, (d) said interconnecting arches forming a tunnel having two ends that are closed by an end structure, (e) each end structure including two interconnected corner assemblies, (f) each corner assembly including three frame members each in the form of a quadlilateral having two shorter sides of equal lengths and two longer sides of equal lengths, (g) the angles between pairs of adjacent sides of the frame members being substantially 81.6°, 81.6°, 81.6° and 115.2° respectively, (h) a respective strip of sheet material is secured between each pair of adjacent arches, (i) the width of each said strip being slightly less than the corresponding spacing in which it is secured between the arches, (j) the strips being further fastened to the structure to be under tension longitudinally, and (k) the end structures are covered with sheet material which is connected to their frameworks under tension.

24. In a building structure having a generally rectangular floor plan and composed of a framework covered by a sheet material, said framework comprising:

(a) a plurality of interconnected parallel arches which extend at right-angles to an axis of symmetry of the floor plan of the building structure, (b) cross-pieces being effective to join the arches together to form a tunnel having two ends that are closed by an end structure, (c) the sheet material being connected to the framework under tension, (d) each arch including at least four identical, rectilinear struts joined end-to-end, and (e) each of the cross-pieces including a strut of substantially identical form to said identical, rectilinear struts of said arches.

* * * * *